US006816055B2

(12) United States Patent
Weber

(10) Patent No.: US 6,816,055 B2
(45) Date of Patent: Nov. 9, 2004

(54) ADJUSTING DEVICE FOR A THERMAL TRIP ELEMENT

(75) Inventor: Christoph Weber, Ergoldsbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/470,692

(22) PCT Filed: Jan. 18, 2002

(86) PCT No.: PCT/DE02/00155

§ 371 (c)(1),
(2), (4) Date: Jul. 31, 2003

(87) PCT Pub. No.: WO02/061785

PCT Pub. Date: Aug. 8, 2002

(65) Prior Publication Data

US 2004/0100350 A1 May 27, 2004

(30) Foreign Application Priority Data

Jan. 31, 2001 (DE) ..... 101 04 272

(51) Int. Cl.[7] ..... H01H 37/20; H01H 37/12

(52) U.S. Cl. ..... 337/82; 337/84; 335/144

(58) Field of Search ..... 337/36, 37, 57, 337/67, 82, 84, 93, 94, 319, 323, 330, 347, 349, 357, 360, 368, 374; 335/45, 144, 185, 197, 186; 361/163

(56) References Cited

U.S. PATENT DOCUMENTS 3,665,360 A * 5/1972 Norden ..... 337/100
3,973,232 A * 8/1976 Hickling ..... 337/94
4,069,464 A * 1/1978 Bollinger et al. ..... 337/77
4,090,166 A * 5/1978 Burch ..... 337/360
4,236,136 A * 11/1980 Heydner et al. ..... 337/111
4,445,105 A * 4/1984 Wehl ..... 337/94
4,510,481 A * 4/1985 Ubukata et al. ..... 337/368
4,642,598 A * 2/1987 Ichikawa et al. ..... 337/82
4,682,141 A * 7/1987 Hickling ..... 337/379
4,922,220 A * 5/1990 Livesey et al. ..... 337/82
5,317,471 A * 5/1994 Izoard et al. ..... 361/105
5,781,097 A * 7/1998 Givler ..... 337/367
5,894,259 A * 4/1999 Kolberg et al. ..... 337/333
6,078,246 A * 6/2000 Davis et al. ..... 337/347
6,095,678 A * 8/2000 Meili et al. ..... 374/1
6,104,273 A * 8/2000 Larranaga et al. ..... 337/82
6,135,633 A * 10/2000 DiMarco et al. ..... 374/1
6,445,274 B1 * 9/2002 Malingowski et al. ..... 337/49
6,621,403 B2 * 9/2003 Nagahiro et al. ..... 337/75

FOREIGN PATENT DOCUMENTS

DE 1904731 8/1970
DE 2646840 4/1978
DE 3517039 11/1986
EP 0143981 6/1985
EP 213270 A1 * 3/1987 ..... H01H/71/16
EP 0338868 10/1989
EP 0412953 2/1991
EP 0913848 5/1999

* cited by examiner

*Primary Examiner*—Anatoly Vortman
(74) *Attorney, Agent, or Firm*—Harness, Dickey & Pierce, P.L.C.

(57) ABSTRACT

An adjusting device is for a thermal trip element of a switchgear. It includes a bimetallic element that is stationarily fixed on a bimetallic support. The free end of the bimetallic element is spaced apart form a trip lever and increasingly impinges the same in the direction of release was a result of the thermal deformation, the distance being adjustable by bending the bimetallic support. The adjusting device is especially suitable for circuit breakers or the like.

29 Claims, 2 Drawing Sheets

ADJUSTING DEVICE FOR A THERMAL TRIP ELEMENT

This application is the national phase under 35 U.S.C. §371 of PCT International Application No. PCT/DE02/00155 which has an International filing date of Jan. 18, 2002, which designated the United States of America and which claims priority on German Patent Application number DE 101 04 272.8 filed Jan. 31, 2001, the entire contents of which are hereby incorporated herein by reference.

FIELD OF THE INVENTION

The invention generally relates to an adjusting apparatus for a thermal release of a switching device. A switching device is understood here to be a mechanical or electromechanical switching device, in particular power breakers, circuit breakers, relays, contactors and the like.

BACKGROUND OF THE INVENTION

An adjusting apparatus is known from EP 0 913 848 A2.

A switching device serves the purpose of connecting a circuit to an electrical power supply system and isolating the circuit manually and automatically from the supply system if the current exceeds a predetermined value. A power breaker, for example, thus serves the purpose of protecting lines in installations and systems from overload and short circuit In a supply system having a shutdown facility using overcurrent protection devices for disconnection, such a switching device also prevents touch voltages which are too high from being maintained in the event of a fault.

When the switching device or circuit breaker is switched on, an energy store, for example a spring, is stressed as part of a mechanical switching mechanism or breaker mechanism, is released for the tripping operation and operates the switch. Here, the switching device includes a thermal release in the form of a bimetallic element which is usually in the form of a strip and which trips with a delay depending on the overload duration. The tripping operation is initiated by thermal deformation of the bimetallic strip as a result of the overcurrent passing through it. For this purpose, the bimetallic strip acts on a tripping lever which is opposite the free end of the bimetallic strip, spaced apart from it, and is mechanically coupled to the breaker mechanism. The tripping lever thus causes the bimetallic strip to release the breaker mechanism whilst the energy store of the breaker mechanism opens a moveable contact or moving contact by lifting the contact from a fixed contact. In addition, the switching device also usually includes a magnetic or electromagnetic release, which trips without a delay, for high surge and short-circuit currents.

The distance between the free end of the bimetallic element and the tripping lever is to be designed to be adjustable, for which purpose an adjusting screw is usually provided. Switching devices in which such an adjusting screw is used to adjust the bimetallic element are known, for example, from DE 1 904 731 A1 and from EP 0 143 981 A1 as well as from EP 0 412 953 A3. The use of an adjusting screw does, however, entail corresponding production and manufacturing costs.

EP 0 913 848 A2 also discloses a method for thermally calibrating the tripping mechanism of a switching device and a corresponding tripping mechanism, in which the adjustment is carried out thermally, by way of a laser.

SUMMARY OF THE INVENTION

An embodiment of the invention is based on an object of proposing a particularly cost-effective adjusting apparatus, which is easy to operate, for a switching device, in particular for a power breaker.

For this purpose, the distance between the tripping lever and the free end, which acts on the tripping lever increasingly as a result of thermal deformation in the tripping direction, of the bimetallic element can be set by bending a bimetallic support which is firmly connected to the bimetallic element.

Here, the bimetallic support has at least one predetermined bending point, preferably two or three predetermined bending points. By this, the bimetallic support acts as a multi-link chain or multi-joint mechanism when it is fixed or mounted in the enclosure of such a switching device. The bimetallic support has, in the region of a first predetermined bending point, a retaining limb, which runs parallel to the bimetallic element and is connected to its contact end, as well as an operating limb, which runs at least approximately transversely with respect to the retaining limb. The free end of the operating limb can be guided in or against an enclosure profile, this free end being guided or held, by way of a corresponding actuating tool, such that it can pivot on a bending path which is at least approximately in the form of a circular arc.

A further, second predetermined bending point may be provided either along the retaining limb or on the limb end of the retaining limb which is remote from the operating limb. In this embodiment, the bimetallic support merges at this second predetermined bending point with a fixing limb which runs transversely with respect to the retaining limb, expediently at an obtuse angle. The fixing limb itself is then expediently in turn bent back twice, resulting in an overall approximately U-shaped fixing limb and thus a bimetallic support which is bent, overall, in the form of a ring or a loop.

With this configuration, which is, for example, in the form of a ring or a loop, of the bimetallic support, the operating limb which extends from the first predetermined bending point is bent inward or outward. If the operating limb is bent outward, its end is guided against an adjustment profile in the form of an arc. This profile is preferably provided by an appropriate enclosure profile of the switching device.

This adjustment or enclosure profile which is in the form of an arc has a diminishing radius in which the operating limb lies. When the operating limb is rotated about the first predetermined bending point, forming a pivot, against the adjustment profile, the bimetallic support is bent and thus the position of the bimetallic element is changed for the purpose of adjusting the bimetallic element. Here, the transformation ratio of the angle of rotation of the operating limb to the movement of the free end of the bimetallic element can be set, depending on the requirements, by correspondingly configuring the adjustment and enclosure profile.

When the operating limb is bent inward, a further (third) predetermined bending point is expediently provided along the operating limb. A positioning pin, which runs transversely with respect to the longitudinal direction of the limb and can be fixed in position in a positioning opening, which is in a fixed position, in the enclosure of the switching device, is then integrally formed on the operating limb between this (third) predetermined bending point and the free end of the operating limb.

In this embodiment of the bimetallic support and thus of the adjusting apparatus, too, the bimetallic support is in turn bent by rotating the operating limb about the pivots formed by the two predetermined bending points, and thus the position of the bimetallic element is changed for adjustment purposes. In both embodiments, the distance between the free end of the bimetallic element or the tip of the bimetallic element and the tripping lever is thus set or adjusted by bending the bimetallic support. The predetermined bending points are expediently formed by material cutouts in the corresponding vertices of the bends in the bimetallic support.

Advantages achieved by an embodiment of the invention include, in particular, the fact that, by appropriately configuring and arranging a bimetallic support bearing the bimetallic element, it is possible to bend the the bimetallic support specifically and thus to provide a simple and cost-effective adjusting apparatus for a thermal release of a switching device.

This mechanism, which serves the purpose of adjusting the bimetallic element and in which the bimetallic support, which is expediently provided with predetermined bending points, acts in the manner of a multi-link chain, in particular a three- or four-link chain, also makes possible virtually automatic or independent compensation for subsequent shrinkage of the enclosure. Such shrinkage, to which enclosure materials which are usually used are subject, leads, over the life of the device, to undesirable changes in important structural and dimensional proportions, such as, in particular, the distance between the tip of the bimetallic element and the tripping lever, and thus to an undesirable maladjustment or displacement of the thermal release as well.

BRIEF DESCRIPTION OF THE DRAWINGS

Exemplary embodiments of the invention are explained in more detail below with reference to drawings, in which.

Corresponding parts are given the same reference symbols in all the figures.

DETAILED DESCRIPTION OF THE PREFERRED EMBODIMENTS

Figure 1:
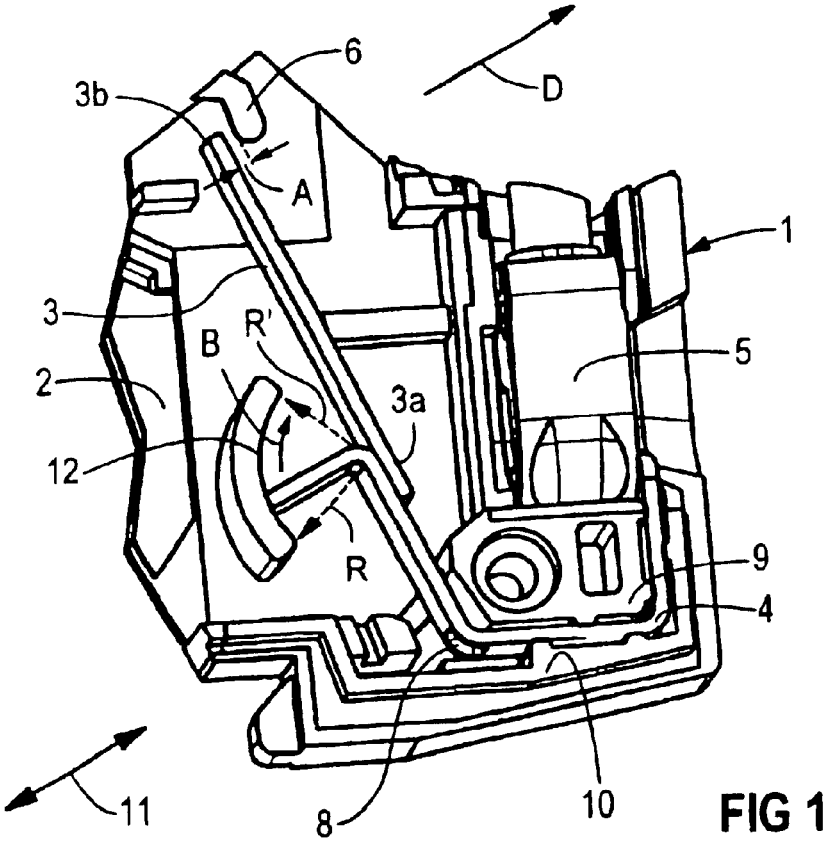
FIG. 1 shows a perspective illustration of a thermal tripping apparatus, which is mounted at the end in a switching device, with a first embodiment of an adjusting apparatus according to an embodiment of the invention having a bimetallic support with two predetermined bending points.
Figure 3:
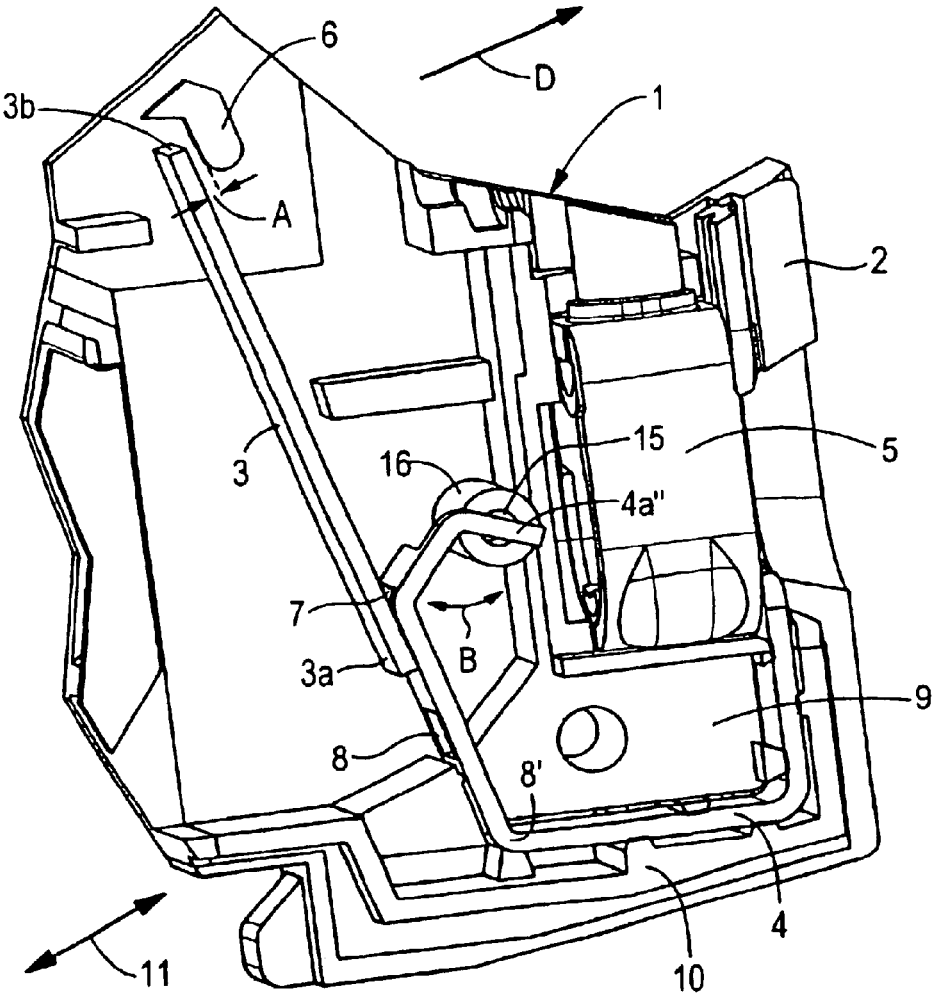

FIGS. 1 and 3 show details of a switching device 1 with the enclosure cover of the enclosure 2 of the switching device removed, in which the essential parts of an adjustable thermal release can be seen. The thermal release has a bimetallic strip 3, whose contact end 3*a* is connected, by techniques such as soldering, bonding or welding, to a bimetallic support 4 and is thus retained in a fixed position. The bimetallic support 4 is connected to a supply terminal 5 in an electrically conductive manner in order to pass current through the switching device 1.

The free end 3*b* of the bimetallic element 3, i.e. the tip of the bimetallic element, lies opposite a tripping lever 6, spaced apart from it, the tripping lever being coupled, in a manner known per se, to a switching mechanism or breaker mechanism, not illustrated in any further detail. This distance A between the tip 3*b* of the bimetallic element and the tripping lever 6 can be set by bending the bimetallic support 4.

Figure 2:
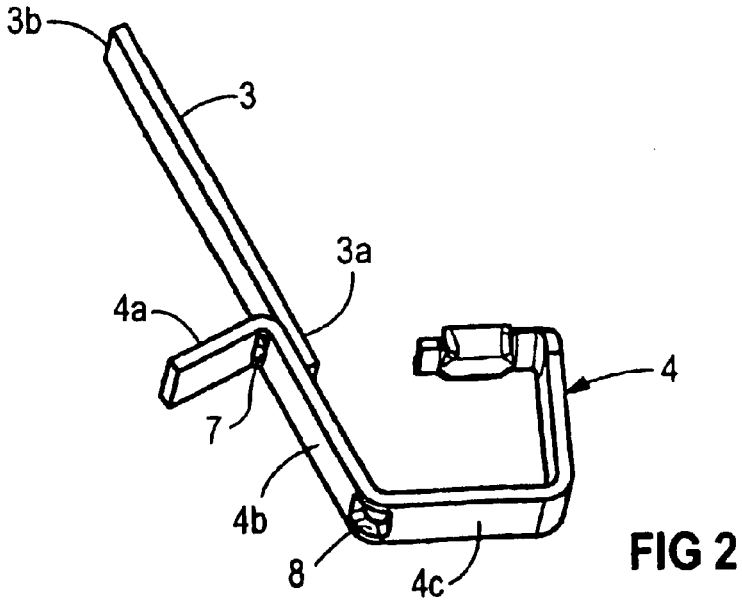
FIG. 2 shows the bimetallic support from FIG. 1 connected to a bimetallic strip, FIG. 3, in an illustration as shown in FIG. 1, shows a second embodiment of the adjusting apparatus according to the invention with a bimetallic support having three predetermined bending points, and FIG. 4, in an illustration as shown in FIG. 2, shows the bimetallic support from FIG. 3.

In the embodiment of the adjustable thermal release and thus of the adjusting apparatus shown in FIGS. 1 and 2, the bimetallic support 4 is bent back twice or more in the manner of a three-link chain. In this case, an operating limb 4*a* and a retaining limb 4*b*, which runs transversely with respect to, i.e. at least approximately at right angles to, the operating limb, of the bimetallic support 4 are formed at a first predetermined bending point 7. The contact end 3*a* of the bimetallic element 3 is connected, by techniques such as soldering, bonding or welding, to this retaining limb 4*b*.

The retaining limb 4*b* merges, in this embodiment, with a fixing limb 4*c* at a second predetermined bending point 8, the fixing limb itself being bent so as to be approximately U-shaped. The bimetallic support 4 is fixed in position, by way of this fixing limb 4*c*, in the enclosure 2 by corresponding enclosure fittings or profiles 9, 10. Here, the retaining limb 4*b* can be bent both about the (second) predetermined bending point 8 and about the (first) predetermined bending point 7 in the direction of the double-headed arrow 11 and is thus enclosed in the enclosure 2, without bearing against it, over the entire length of the retaining limb.

The operating limb 4*a*, pointing outward, of the bimetallic support 4 is guided at the end against an enclosure profile in the form of and arc and is supported on this. This enclosure profile forms the adjustment profile 12 in the form of an arc for the purpose of adjusting the bimetallic element. The radius R of this adjustment profile 12, determining an adjustment path B in the form of a circle or circular arc, decreases in the clockwise direction to a smaller radius R'.

In order to adjust the bimetallic element and thus to set the distance A between the free end 3*b* of the bimetallic element 3 and the tripping lever 6, the operating limb 4*a* of the bimetallic support 4 is rotated, by way of an operating tool (not shown), about the pivot formed by the first predetermined bending point 7 against the adjustment profile 12, and thus the bimetallic support 4 is bent, with the result that the position of the bimetallic element 3 is correspondingly changed for the purpose of setting the distance A. Thus, when the operating limb 4*a* is turned in the clockwise direction, i.e. in the direction of the arrow, illustrated, of the adjustment path B, the bimetallic element 3, and thus its free end or the tip 3*b* of the bimetallic element, is turned in the tripping direction D. In this embodiment, the adjusting apparatus is essentially formed by the bimetallic support 4, having the bimetallic element 3 retained on it, and the adjustment profile 12.

Figure 4:
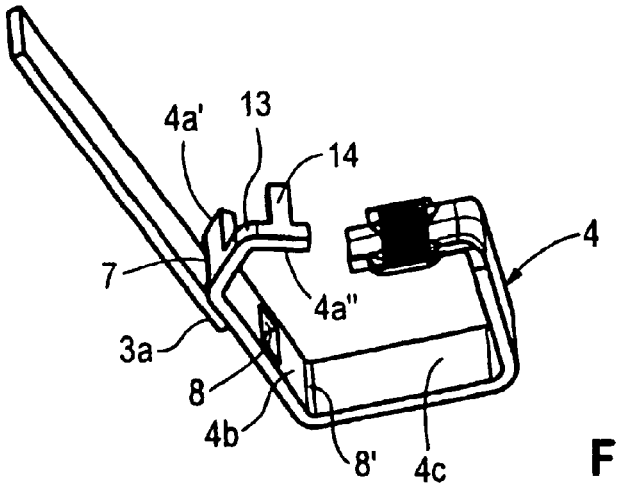

In the embodiment of the bimetallic support 4 shown in FIGS. 3 and 4, the second predetermined bending point 8 is provided approximately in the central region of the retaining limb 4*b* of the bimetallic support 4. Up to this predetermined bending point 8, the bimetallic support 4 is then clamped, in a force-fitting manner, to the fixing limb 4*c* of this bimetallic support between the correspondingly configured enclosure fittings or profiles. Thus, only a limb section of the retaining limb 4*b* and, in the extension of the retaining limb over the first predetermined bending point 7, the operating limb 4'*a* can be bent in the direction of the double-headed arrow 11. The fixing limb 4*c*, which, in this embodiment, adjoins the retaining limb 4*b* via a bend 8', of the bimetallic support 4 is in turn bent so as to be at least approximately U-shaped.

In this embodiment, the operating limb 4'*a* is bent inward and, at the same time, is itself bent back, forming a third predetermined bending point 13, with the result that the bimetallic support 4 acts in the manner of a four-link chain. The first and second predetermined bending points 7 and 8, respectively, are, in the two embodiments in FIGS. 2 and 4, formed by holes or stampings in the sheet metal material of the bimetallic support 4. In the embodiment in FIGS. 3 and 4, the third predetermined bending point 13 is expediently also produced by a corresponding material cutout.

At the free end, a pivot or positioning pin 14 is integrally formed on the operating limb 4'*a* and is formed by a material cutout in the operating limb 4'*a*, which is in the form of a sheet metal tab. By way of this pivot pin 14, the operating limb 4'*a* engages in an enclosure receptacle or pivot opening 15, acting as the pivot profile, which is provided in an appropriately positioned enclosure profile, expediently in the form of an enclosure structure 16 which is in the form of a dome. The actuating tool grips the free end 4"*a*, lying in the region of the pivot pin 14, of the operating limb 4'*a*, for the purpose of adjusting the bimetallic element.

In this embodiment, too, the bimetallic support 4 is in turn bent by rotating the operating limb 4'*a* in the direction of the double-headed arrow B, illustrated, and the position of the bimetallic element 3 is changed for the purpose of setting the distance A. Here too, when the operating limb 4*a* is turned in the clockwise direction of the arrow direction, illustrated, of the adjustment path B, the tip of the bimetallic element or the free end 3*b* of the bimetallic element 3 is turned in the tripping direction D and, by this, the bimetallic element is adjusted. In the process, the pivot joint, formed by the pivot pin 14 and the pivot opening 15, in turn determines the adjustment path B which is in the form of a circle or circular arc and is symbolized by the double-headed arrow. Here, the adjusting apparatus is essentially formed by the bimetallic support 4, with the bimetallic element 3 held on it, and the pivot opening 15, acting as the adjustment profile, in the enclosure attachment 16.

In both embodiments, the mechanism, which serves the purpose of adjusting the bimetallic element and acts in the manner of a multi-link chain by way of the predetermined bending points 7 and 8 or 7, 8 and 13 provided along the bimetallic support 4, advantageously also compensates for any virtually unavoidable subsequent shrinkage of the enclosure. If, owing to such shrinkage of the enclosure, the position of the tripping lever 6 changes in the direction of increasing the distance A, this shrinkage also causes the enclosure profile 12, acting as the adjustment profile, or the enclosure attachment 16—and thus the pivot opening 15 acting as the adjustment profile—to move closer to the bimetallic element 3. This in turn causes the bimetallic support 4 to bend automatically and thus the bimetallic element 3 to then be readjusted toward the tripping lever 6, which is moving further away, so that the distance A remains virtually constant.

Thus, in the embodiment in FIG. 1, the distance or the dimension A increases owing to shrinkage of the enclosure. At the same time, the profile 12 moves toward the profile 9 and the bimetallic strip 3 or its tip 3*b* is then readjusted in the clockwise direction.

In contrast, in the embodiment in FIG. 3, the distance or the dimension A decreases as a result of shrinkage of the enclosure, the profile 16 moving toward the fixing profile 9. By this, the distance between the two predetermined bending points 8 and 13 is reduced, causing the predetermined bending point 7 to be pushed in the opposite direction to the tripping direction D and the bimetallic element 3 to be moved in the counterclockwise direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An adjusting apparatus for a thermal release of a switching device comprising:

a bimetallic support; and a bimetallic element held in a fixed position on the bimetallic support, wherein a free end of the bimetallic element is spaced apart from a tripping lever and acts on the tripping lever as a result of thermal deformation increasingly in the tripping direction, wherein distance is settable by bending the bimetallic support, the bimetallic support including, in a region of a first predetermined bending point, a retaining limb running parallel to the bimetallic element and connected to a contact end of said bimetallic element, and including an operating limb, running approximately transversely with respect to said retaining limb, a free end of the operating limb being guided at least one of in and against an enclosure profile and pivotable on an at least approximately circular adjustment path.

2. The adjusting apparatus as claimed in claim 1, wherein the bimetallic support includes, along the retaining limb, a second predetermined bending point, spaced apart from the first predetermined bending point.

3. The adjusting apparatus as claimed in claim 1, wherein the bimetallic support includes a fixing limb, adjoining the retaining limb via a bend, wherein the fixing limb is at least approximately U-shaped.

4. The adjusting apparatus as claimed in claim 1, wherein the end of the operating limb of the bimetallic support is guided against an adjustment profile in the form of an arc.

5. The adjusting apparatus as claimed in claim 4, wherein the adjustment profile forms an adjustment path at least approximately in the form of a circular arc and including a decreasing radius.

6. The adjusting apparatus as claimed in claim 1, wherein the operating limb of the bimetallic support includes a pivot pin, running transversely with respect to the longitudinal direction of the limb and fixable in position in a pivot opening, the pivot opening being in a fixed position, a further predetermined bending point being provided between said pivot pin and the first predetermined bending point.

7. The adjusting apparatus as claimed in claim 1, wherein at least one predetermined bending point is formed by a material cutout in the respective vertex of the bend in the bimetallic support.

8. A switching device including the adjusting apparatus as claimed in claim 1.

9. The switching device as claimed in claim 8, wherein the adjusting apparatus is adapted to compensate for shrinkage of the enclosure such that, upon the distance between the tripping lever and the free end of the bimetallic element changing, the tripping lever moves automatically in a corresponding manner in at least one of a clockwise and counterclockwise direction.

10. The adjusting apparatus as claimed in claim 2, wherein the bimetallic support includes a fixing limb, adjoining the retaining limb via a bend, wherein the fixing limb is at least approximately U-shaped.

11. The adjusting apparatus as claimed in claim 2, wherein the end of the operating limb of the bimetallic support is guided against an adjustment profile in the form of an arc.

12. The adjusting apparatus as claimed in claim 11, wherein the adjustment profile forms an adjustment path at least approximately in the form of a circular arc and including a decreasing radius.

13. The adjusting apparatus as claimed in claim 3, wherein the end of the operating limb of the bimetallic support is guided against an adjustment profile in the form of an arc.

14. The adjusting apparatus as claimed in claim 13, wherein the adjustment profile forms an adjustment path at least approximately in the form of a circular arc and including a decreasing radius.

15. The adjusting apparatus as claimed in claim 2, wherein the operating limb of the bimetallic support includes a pivot pin, running transversely with respect to the longitudinal direction of the limb and fixable in position in a pivot opening the pivot opening being in a fixed position, a further predetermined bending point being provided between said pivot pin and the first predetermined bending point.

16. The adjusting apparatus as claimed in claim 3, wherein the operating limb of the bimetallic support includes a pivot pin, running transversely with respect to the longitudinal direction of the limb and fixable in position in a pivot opening, the pivot opening being in a fixed position, a further predetermined bending point being provided between said pivot pin and the first predetermined bending point.

17. The adjusting apparatus as claimed in claim 2, wherein at least one predetermined bending point is formed by a material cutout in the respective vertex of the bend in the bimetallic support.

18. The adjusting apparatus as claimed in claim 6, wherein at least one predetermined bending point is formed by a material cutout in the respective vertex of the bend in the bimetallic support.

19. The adjusting apparatus as claimed in claim 15, wherein at least one predetermined bending point is formed by a material cutout in the respective vertex of the bend in the bimetallic support.

20. A switching device including the adjusting apparatus as claimed in claim 2.

21. A switching device including the adjusting apparatus as claimed in claim 6.

22. A power breaker including the adjusting apparatus as claimed in claim 1.

23. A power breaker including the adjusting apparatus as claimed in claim 2.

24. A power breaker including the adjusting apparatus as claimed in claim 6.

25. The switching device as claimed in claim 20, wherein the adjusting apparatus is adapted to compensate for shrinkage of the enclosure such that, upon the distance between the tripping lever and the free end of the bimetallic element changing, the tripping lever moves automatically in a corresponding manner in at least one of a clockwise and counterclockwise direction.

26. The switching device as claimed in claim 21, wherein the adjusting apparatus is adapted to compensate for shrinkage of the enclosure such that, upon the distance between the tripping lever and the free end of the bimetallic element changing, the tripping lever moves automatically in a corresponding manner in at least one of a clockwise and counterclockwise direction.

27. The power breaker as claimed in claim 22, wherein the adjusting apparatus is adapted to compensate for shrinkage of the enclosure such that, upon the distance between the tripping lever and the free end of the bimetallic element changing, the tripping lever moves automatically in a corresponding manner in at least one of a clockwise and counterclockwise direction.

28. The power breaker as claimed in claim 23, wherein the adjusting apparatus is adapted to compensate for shrinkage of the enclosure such that, upon the distance between the tripping lever and the free end of the bimetallic element changing, the tripping lever moves automatically in a corresponding manner in at least one of a clockwise and counterclockwise direction.

29. The power breaker as claimed in claim 24, wherein the adjusting apparatus is adapted to compensate for shrinkage of the enclosure such that, upon the distance between the tripping lever and the free end of the bimetallic element changing, the tripping lever moves automatically in a corresponding manner in at least one of a clockwise and counterclockwise direction.

* * * * *